US008737864B2

(12) United States Patent
Mori et al.

(10) Patent No.: US 8,737,864 B2
(45) Date of Patent: May 27, 2014

(54) GROUNDING CONFIGURATION FOR AN IMAGE FORMING APPARATUS

(75) Inventors: Shogo Mori, Nagoya (JP); Takuya Yamaguchi, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 139 days.

(21) Appl. No.: 13/422,171

(22) Filed: Mar. 16, 2012

(65) Prior Publication Data

US 2013/0077986 A1 Mar. 28, 2013

(30) Foreign Application Priority Data

Sep. 28, 2011 (JP) ..... 2011-212685

(51) Int. Cl.
*G03G 15/00* (2006.01)

(52) U.S. Cl.
USPC ..... 399/90; 399/118

(58) Field of Classification Search
USPC ..... 399/90, 380, 118; 347/117, 118, 138, 347/242, 245, 257, 263
See application file for complete search history.

(56) References Cited

U.S. PATENT DOCUMENTS

| | | | | |
|---|---|---|---|---|
| 7,245,313 | B2 * | 7/2007 | Yamagata | 347/242 |
| 7,840,159 | B2 * | 11/2010 | Nakashima | 399/117 |
| 7,982,761 | B2 * | 7/2011 | Yokoi | 347/242 |
| 8,040,368 | B2 * | 10/2011 | Yokoi | 347/242 |
| 8,310,515 | B2 * | 11/2012 | Yokoi et al. | 347/242 |
| 8,400,481 | B2 * | 3/2013 | Sakai et al. | 347/138 |
| 2003/0222968 | A1 * | 12/2003 | Nagamine | 347/245 |
| 2005/0046912 | A1 * | 3/2005 | Nobe et al. | 358/498 |
| 2009/0162091 | A1 | 6/2009 | Yokoi | |
| 2009/0169260 | A1 * | 7/2009 | Yokoi | 399/177 |

FOREIGN PATENT DOCUMENTS

| | | | |
|---|---|---|---|
| JP | 01251055 | A * | 10/1989 |
| JP | 2002328326 | A * | 11/2002 |
| JP | 2005173098 | A * | 6/2005 |
| JP | 2006308719 | A * | 11/2006 |
| JP | 2009-157001 | | 7/2009 |

* cited by examiner

*Primary Examiner* — Robert Beatty

(74) *Attorney, Agent, or Firm* — Banner & Witcoff, Ltd.

(57) ABSTRACT

An image forming apparatus includes: a main body having an opening; a plurality of photosensitive members disposed in the main body; a cover configured to open and close the opening; and a plurality of exposure members that is provided at the cover and is configured to expose the plurality of photosensitive members, respectively. The cover includes a cover-side metal plate provided along a surface of the cover. Entire parts of the plurality of exposure members overlap with the cover-side metal plate, when seen in a direction normal to the cover-side metal plate. At least four positions of the cover-side metal plate, which surround the plurality of exposure members, are electrically grounded at a state in which the cover is closed.

7 Claims, 8 Drawing Sheets

GROUNDING CONFIGURATION FOR AN IMAGE FORMING APPARATUS

CROSS REFERENCE TO RELATED APPLICATIONS

This application is based upon and claims the benefit of priority of Japanese Patent Application No. 2011-212685 filed on Sep. 28, 2011, the contents of which are incorporated herein by reference in its entirety.

BACKGROUND

The invention relates to an image forming apparatus having a plurality of exposure members.

An image forming apparatus of an electrophotographic type has been known which includes an upper cover that opens and closes an opening formed at an main body, a plurality of LED units (exposure members) that exposes a plurality of photosensitive drums and a metal side frame that is provided to the main body.

Specifically, the upper cover has an upper panel (cover-side metal plate) that supports the respective LED units and consists of a metal plate. The upper panel is electrically connected to the side frame (main body-side metal plate) via a conductive cable and is thus grounded in the vicinity of a hinge that connects the upper cover and the main body. The respective LED units are electrically connected to the side frame via a plate spring and are thus grounded.

SUMMARY

However, according to the above image forming apparatus, the upper panel consisting of the metal plate is grounded only in the vicinity of the hinge. Therefore, a part of the upper panel, which is at an opposite side to the hinge and is not grounded, serves as an antenna and emits electromagnetic waves generated from the LED units and the like as noises, so that the upper panel may become a generation source of the noises.

Accordingly, an object of the invention is to provide an image forming apparatus capable of reducing generation of noises.

The aspect of the disclosure provides an image forming apparatus including: a main body having an opening; a plurality of photosensitive members disposed in the main body; a cover configured to open and close the opening; and a plurality of exposure members that is provided at the cover and is configured to expose the plurality of photosensitive members, respectively. The cover includes a cover-side metal plate provided along a surface of the cover. Entire parts of the plurality of exposure members overlap with the cover-side metal plate, when seen in a direction normal to the cover-side metal plate. At least four positions of the cover-side metal plate, which surround the plurality of exposure members, are electrically grounded at a state in which the cover is closed.

BRIEF DESCRIPTION OF DRAWINGS

FIGS. 5A and 5B are sectional views showing the grounding member that is arranged in the support member, in which FIG. 5A shows an opened state of the upper cover and FIG. 5B shows a closed state of the upper cover.

DESCRIPTION OF EXEMPLARY EMBODIMENTS

Hereinafter an exemplary embodiment will be specifically described with reference to the drawings. In the below descriptions, an overall configuration of a color printer 1 (image forming apparatus) will be first briefly described and then characteristic parts of the invention will be specifically described.

In the below descriptions, directions are described, based on a user who is using the color printer 1. That is, the left side of FIG. 1 is referred to as the 'front side,' the right side is referred to as the 'rear side,' the inner side of the direction perpendicular to the paper sheet is referred to as the 'left side' and the front side of the direction perpendicular to the paper sheet is referred to as the 'right side.' Also, the upper and lower directions of the paper sheet are referred to as the 'upper-lower direction.'

<Overall Configuration of Laser Printer>

Figure 1:
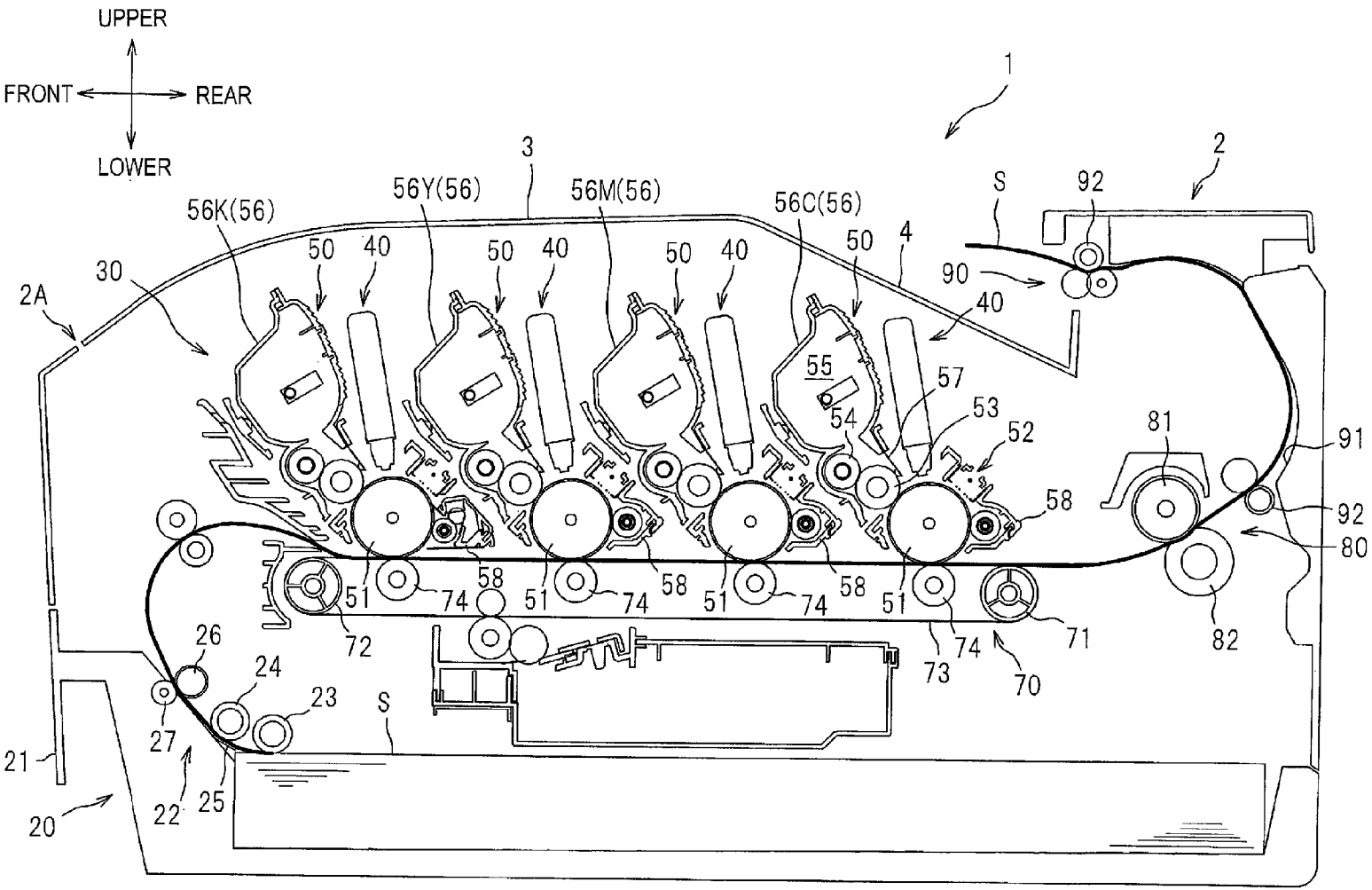
FIG. 1 is a side sectional view showing a color printer according to an illustrative embodiment of the invention.

As shown in FIG. 1, the color printer 1 has, in an main body 2, a feeder unit 20 that feeds a sheet S, an image forming unit 30 that forms an image on the fed sheet S and a sheet discharge part 90 that discharges the sheet P having the image formed thereon.

The main body 2 is formed at its upper part with an opening 2A. The opening 2A is configured so that it is opened and closed by an upper cover 3 that is an example of a cover rotatably supported to the main body 2. An upper surface of the upper cover 3 is configured as a sheet discharge tray 4 on which the sheets P discharged from the main body 2 are stacked.

The feeder unit 20 has a sheet feeding tray 21 that is provided at a lower part in the main body housing 2 and is detachably mounted to the main body 2 and a sheet feeding mechanism 22 that conveys the sheet S from the sheet feeding tray 21 to the image forming unit 30. The sheet feeding mechanism 22 is provided at the front side of the sheet feeding tray 21 and has a sheet feeding roller 23, a separation roller 24 and a separation pad 25.

In the feeder unit 20 configured as described above, the sheets S in the sheet feeding tray 21 are separated and sent upward one by one, and paper dusts are removed while the sheet passes between a paper dust capturing roller 26 and a pinch roller 27. Then, the sheet passes through a conveyance path (not shown), is direction-changed so that it faces backward, and is then fed to the image forming unit 30.

The image forming unit 30 has four (a plurality of) LED units 40 that are an example of the exposure member, four process cartridges 50, a transfer unit 70 and a fixing unit 80.

The LED units 40 are swingably connected to support members 200 (refer to FIG. 2) that are provided below the upper cover 3 and are appropriately positioned by a positioning member (not shown) provided to the main body 2.

The process cartridges 50 are arranged side by side in the front-rear direction between the upper cover 3 and the feeder unit 20, and have four (a plurality of) drum cartridges 58 and developing cartridges 56 that are detachably mounted to the drum cartridges 58.

The drum cartridge 58 has a photosensitive drum 51 that is an example of the photosensitive member, a charger 52 and the like. In the meantime, the drum cartridge 58 may be detachably mounted to the main body 2 or fixed to the main body 2.

The developing cartridge 56 mainly has a developing roller 53, a supply roller 54, a layer thickness regulation blade 57 and a toner accommodation chamber 55 that accommodates therein toner.

The developing cartridges 56 are arranged side by side in order of the developing cartridges 56K, 56Y, 56M, 56C in which color toners for black, yellow, magenta and cyan are respectively included, from an upstream side of a conveyance direction of the sheet S.

The transfer unit 70 is provided between the feeder unit 20 and the respective process cartridges 50 and has a driving roller 71, a driven roller 72, a conveyance belt 73 and transfer rollers 74.

The driving roller 71 and the driven roller 72 are spaced in the front-rear direction and arranged in parallel and the conveyance belt 73 consisting of an endless belt extends therebetween. An outer surface of the conveyance belt 73 abuts on the respective photosensitive drums 53. Also, the four transfer rollers 74 that hold the conveyance belt 73 between the respective photosensitive drums 51 and the transfer rollers are arranged on an inner side of the conveyance belt 73 with opposed to the respective photosensitive drums 51. The transfer rollers 74 are applied with a transfer bias (transfer voltage) having a polarity different from a charged polarity of the toner by constant current control at the time of transfer.

The fixing unit 80 is arranged at the rear side of the respective process cartridges 50 and the transfer unit 70 and has a heating roller 81 and a pressing roller 82 that is opposed to the heating roller 81 and presses the heating roller 81.

In the imaging forming unit 30 configured as described above, for a color printing mode, for example, the surfaces of the respective photosensitive drums 51 are uniformly charged by the chargers 52 and are then exposed by the respective LED units 40. Thereby, potentials of the exposed parts are lowered, so that electrostatic latent images based on image data are formed on the respective photosensitive drums 51. Also, the toner in the toner accommodation chambers 55 is supplied to the developing rollers 53 via the supply rollers 54 and is introduced between the developing rollers 53 and the layer thickness regulation blades 57, so that the toner is carried on the developing rollers 53, as a thin layer having a predetermined thickness.

The toner carried on the developing rollers 53 is supplied to the electrostatic latent images formed on the photosensitive drums 51 from the developing rollers 53. Thereby, the electrostatic latent images become visible and toner images are thus formed on the photosensitive drums 51.

Then, as the sheet S fed onto the conveyance belt 73 passes between the respective photosensitive drums 51 and the respective transfer rollers 74 arranged on the inner side of the conveyance belt 73, the toner images formed on the respective photosensitive drums 51 are transferred onto the sheet S. When the sheet S passes between the heating roller 81 and the pressing roller 82, the toner images transferred onto the sheet S are heat-fixed.

The sheet discharge unit 90 has a sheet discharge-side conveyance path 91 that is formed to extend upward from an exit of the fixing unit 80 and to turn around forward and a plurality of pairs of conveyance rollers 92 conveying the sheet S. The sheet S having the toner images transferred and heat-fixed thereon is conveyed through the sheet discharge-side conveyance path 91 by the conveyance rollers 92, discharged to the outside of the main body 2 and stacked on the sheet discharge tray 4.

<Detailed Configuration Around Upper Cover>

In the below, the configuration around the upper cover 3 is specifically described.

Figure 2:
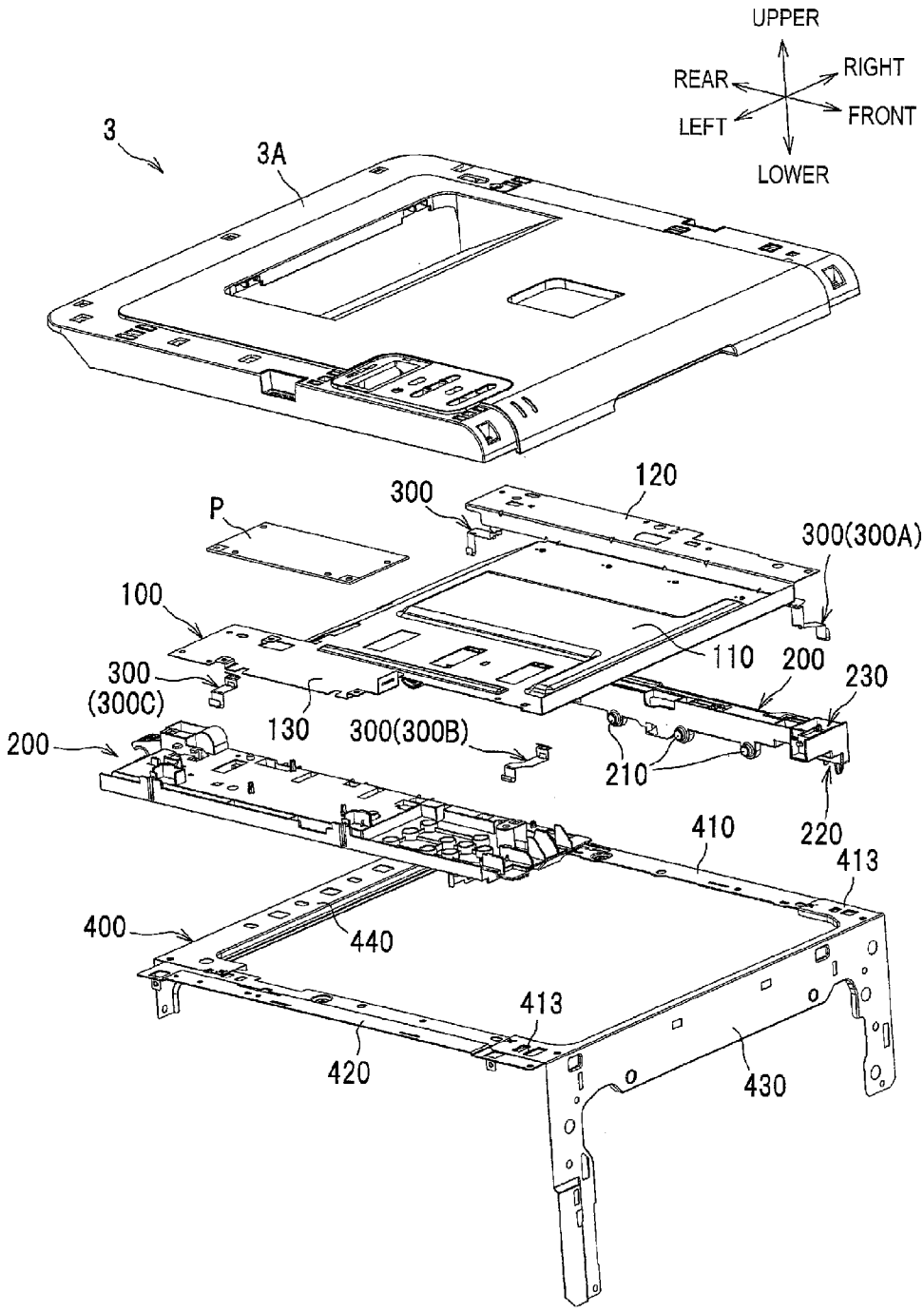
FIG. 2 is a perspective view showing a main body-side metal plate, support members, a cover-side metal plate, an upper cover, grounding members and a control substrate.

As shown in FIG. 2, the upper cover 3 has a cover main body 3A, a cover-side metal plate 100, a pair of left and right support members 200 and four grounding members 300 that are provided to front and rear ends of the respective support members 200.

The cover main body 3A is made of resin and holds the cover-side metal plate 100 and the support members 200. The cover main body 3A has a rear end that is rotatably supported to the main body 2 by a hinge (not shown).

Figure 8:
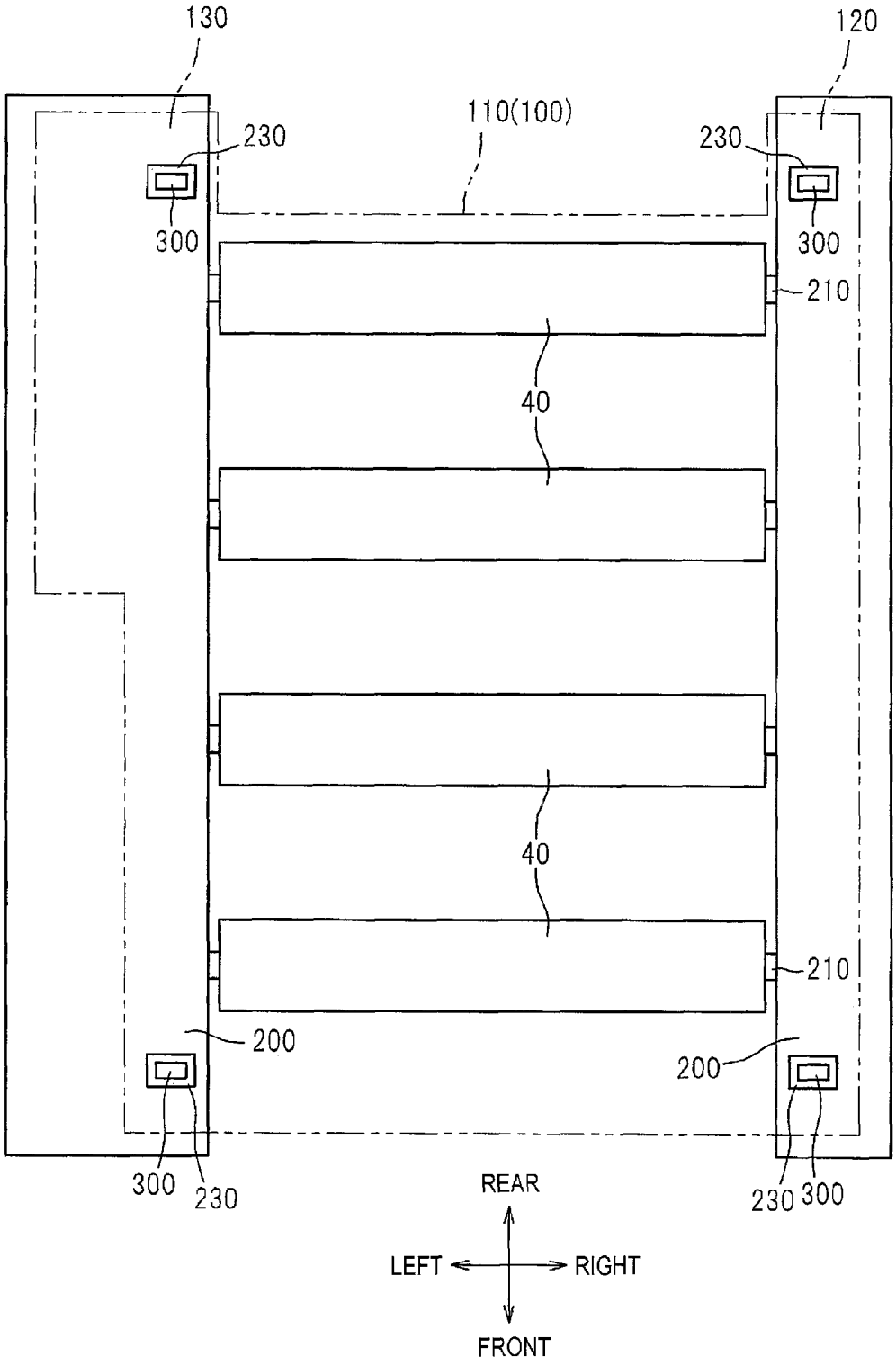
FIG. 8 illustrates an arrangement of LED units, the support member, the cover-side metal plate and the grounding members.

The cover-side metal plate 100 is a metal plate that is provided along a lower surface of the cover main body 3A and has such a size that the four LED units 40 are provided at an inner side of the cover-side metal plate 100, that is, the entire parts of the LED units 40 overlap with the cover-side metal plate 100 when seen in a direction normal to the cover-side metal plate 100 (refer to FIG. 8). Specifically, the cover-side metal plate 100 has a rectangular central part 110 that is arranged above the four LED units 4, an elongated right side part 120 that is arranged at aright end of the central part 110 and is long in the front-rear direction and an elongated left side part 130 that is arranged at a left end of the central part 110 and is long in the front-rear direction.

A control substrate P that controls the LED units 40 is fixed on an upper surface of the left side part 130. That is, the cover-side metal plate 100 is arranged between the four LED units 40 and the control substrate P.

The left and right support members 200 are members that support the four LED units 40, and are arranged below the cover-side metal plate 100. Specifically, each support member 200 extends along an arrangement direction of the four LED units 40 in parallel in the front-rear direction (refer to FIG. 8). The right support member 200 is arranged below the right side part 120 of the cover-side metal plate 100 and the left support member 200 is arranged below the left side part 130 of the cover-side metal plate 100.

Figure 3:
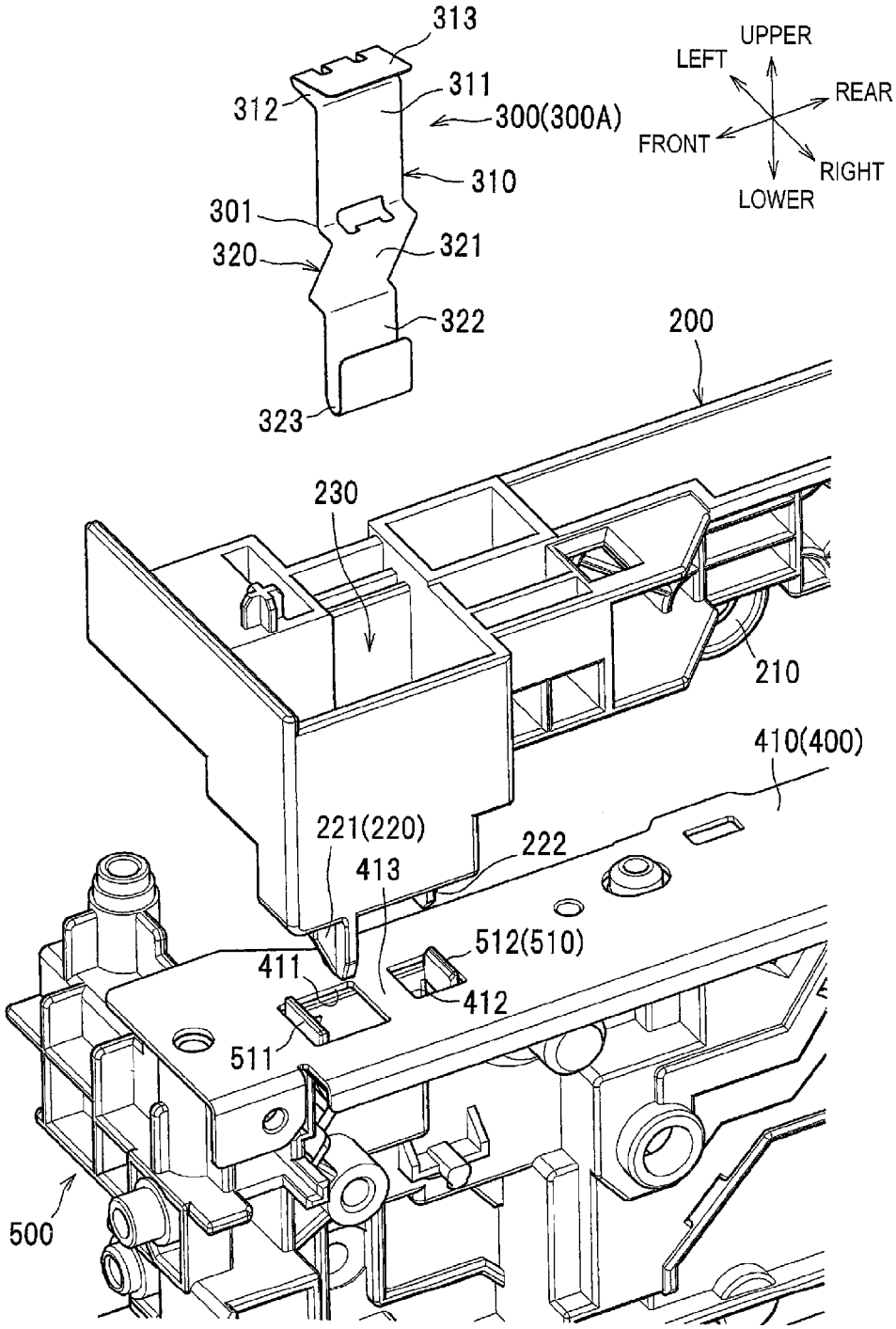
FIG. 3 is a perspective view showing a positioning part of the support member and a positioned part of the main body-side metal plate.

As shown in FIGS. 2 and 3, the support member 200 has LED unit holding parts 210, a positioning part 220 and grounding member supporting parts 230.

The four LED unit holding parts 210 are provided in a line in the front-rear direction on an inner surface of each support member 200 in the left-right direction, i.e., on a surface facing the LED units 40 (only three LED unit holding parts are shown in FIG. 2). The support members 200 hold left and right ends of the respective LED units 40 by the LED unit holding parts 210, thereby swingably supporting the four LED units 40 (refer to FIG. 8).

The positioning part 220 is engaged with a positioned part 510 of the main body 2 (which will be described later), thus positions the support member 200 with respect to a main body frame 500 and is provided at a front end of each support member 200, more specifically at a more forward side than the LED unit holding part 210 that is arranged at the most forward side of each support member 200.

Figure 4:
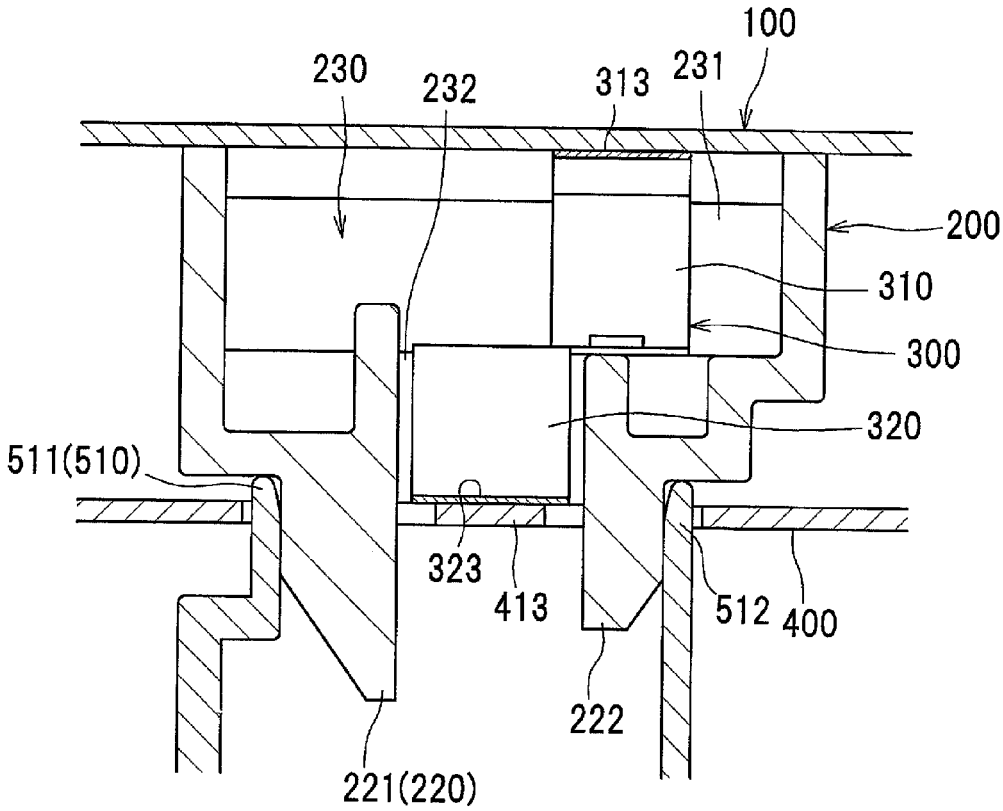
FIG. 4 shows a state in which the positioning part of the support member and the positioned part of the main body-side metal plate are engaged.

As shown in FIGS. 3 and 4, the positioning part 220 has a first positioning protrusion 221 that protrudes downward from a lower surface of the support member 200 and a second positioning protrusion 222 that is arranged at a more rearward position than the first positioning protrusion 221.

The grounding member supporting parts 230 are parts that support the grounding members 300 and are formed at front and rear ends of each support member 200, more specifically at two outermore positions than each LED unit holding part 210 in the front-rear direction (refer to FIG. 8).

Figure 5A:
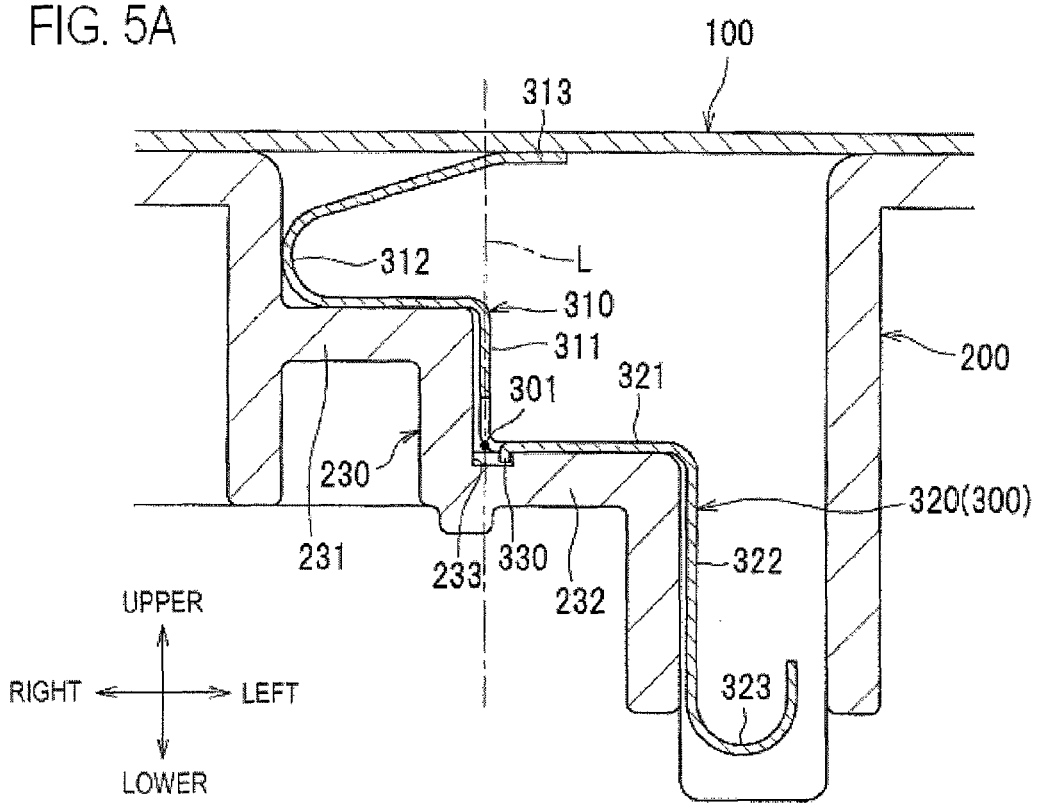

As shown in FIG. 5A, the grounding member supporting part 230 is formed to follow a shape of the grounding member 300. Specifically, the grounding member supporting part 230 has a first support part 231 that extends leftward and rightward at a position one stage lower than an upper surface of the support member 200 and has a right end extending downward, a second support part 232 that extends rightward from a lower end of the first support part 231 and has a right end extending downward, and a hole 233 that is formed on an upper surface of a left end portion of the second support part 232.

The grounding member 300 is a plate spring that is formed by bending a metal plate, and has a first arm 310 and a second arm 320 extending from a bent part 301.

The first arm 310 has a first extension part 311 that extends in the upper-lower direction and a first bent part 312 that extends rightward from an upper end of the first extension part 311, is bent into a substantial U shape and then extends leftward obliquely toward the upper. A leading end of the first bent part 312 extends up to a more leftward position that the bent part 301 that is a connection part of the first arm 310 and the second arm 320, when seen from the upper-lower direction, and forms a first contact portion 313 that is a part contacting the cover-side metal plate 100.

The second arm 320 has a second extension part 321 that extends leftward from a lower end (bent part 301) of the first extension part 311 of the first arm 310 and a second bent part 322 that extends downward from a left end of the second extension part 321 and is bent into a substantial U shape. A lower end portion (bottom portion of the U shape) of the second bent part 322 is a second contact portion 323 that is a part contacting the main body-side metal plate 400, and protrudes from a lower surface of the support member 200 at a state in which the upper cover 3 is opened.

Also, the grounding member 300 has a fixed part 330 that is formed by lowering the connection part of the first arm 310 and the second arm 320, protrudes downward from the second extension part 321 and is engaged with the hole 233.

In the meantime, as shown in FIG. 2, the four grounding members 300 have shapes that are somewhat different. However, the basic structures thereof are the substantially same as the structure shown in FIG. 5A. That is, the grounding member 300 shown in FIG. 5A is a grounding member 300C that is arranged at a left-rear side. The other grounding members 300 are also configured to be same as the grounding member 300C.

Figure 6:
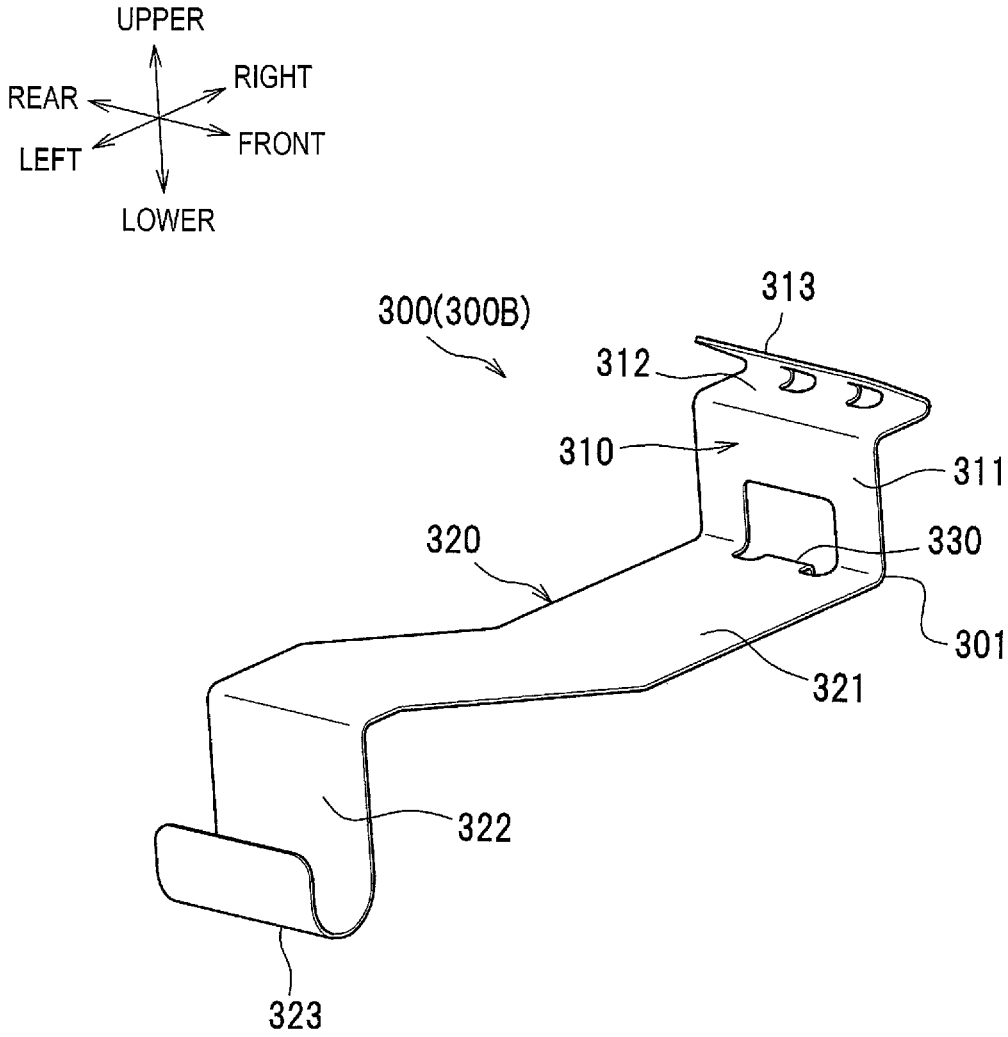
FIG. 6 is a perspective view showing the grounding member.

For example, as shown in FIG. 6, an grounding member 300B that is arranged at a left-front side also has the first arm 310, the second arm 320 and the fixed part 330 that is formed at the connection part of the first arm 310 and the second arm 320. Specifically, the first arm 310 has the first extension part 311 that extends in the upper-lower direction and the first bent part 312 that extends rightward from an upper end of the first extension part 311 and is bent into a substantial U shape. The second arm 320 has the second extension part 321 that extends leftward from a lower end of the first extension part 311 and the second bent part 322 that extends downward from a left end of the second extension part 321 and is bent into a substantial U shape.

As shown in FIG. 5A, each grounding member 300 formed as described above is arranged in the grounding member supporting part 230 by inserting the fixed part 330 into the hole 233 and resting the second extension part 321 of the second arm 320 on the second support part 232. Regarding a plane L that passes to the bent part 301 and extends along an opening and closing direction of the upper cover 3 just before the upper cover 3 is closed, i.e., along the upper-lower direction, the first contact portion 313 of the first arm 310 and the second contact portion 323 of the second arm 320 are arranged at the same side.

The grounding member 300 that is provided at a front side of the support member 200 is arranged in the grounding member supporting part 230 of the support member 200 and is thus provided in the vicinity of the positioning part 220. More specifically, as shown in FIG. 4, the second contact portion 323 of the second arm 320 is arranged between the first positioning protrusion 221 and the second positioning protrusion 222 of the support member 200.

The four grounding members 300 are provided to the grounding member supporting parts 230 of the respective support members 200, so that a line connecting the respective grounding members 300 surrounds the four LED units 400, when seen from the upper-lower direction, as shown in FIG. 8.

Figure 7:
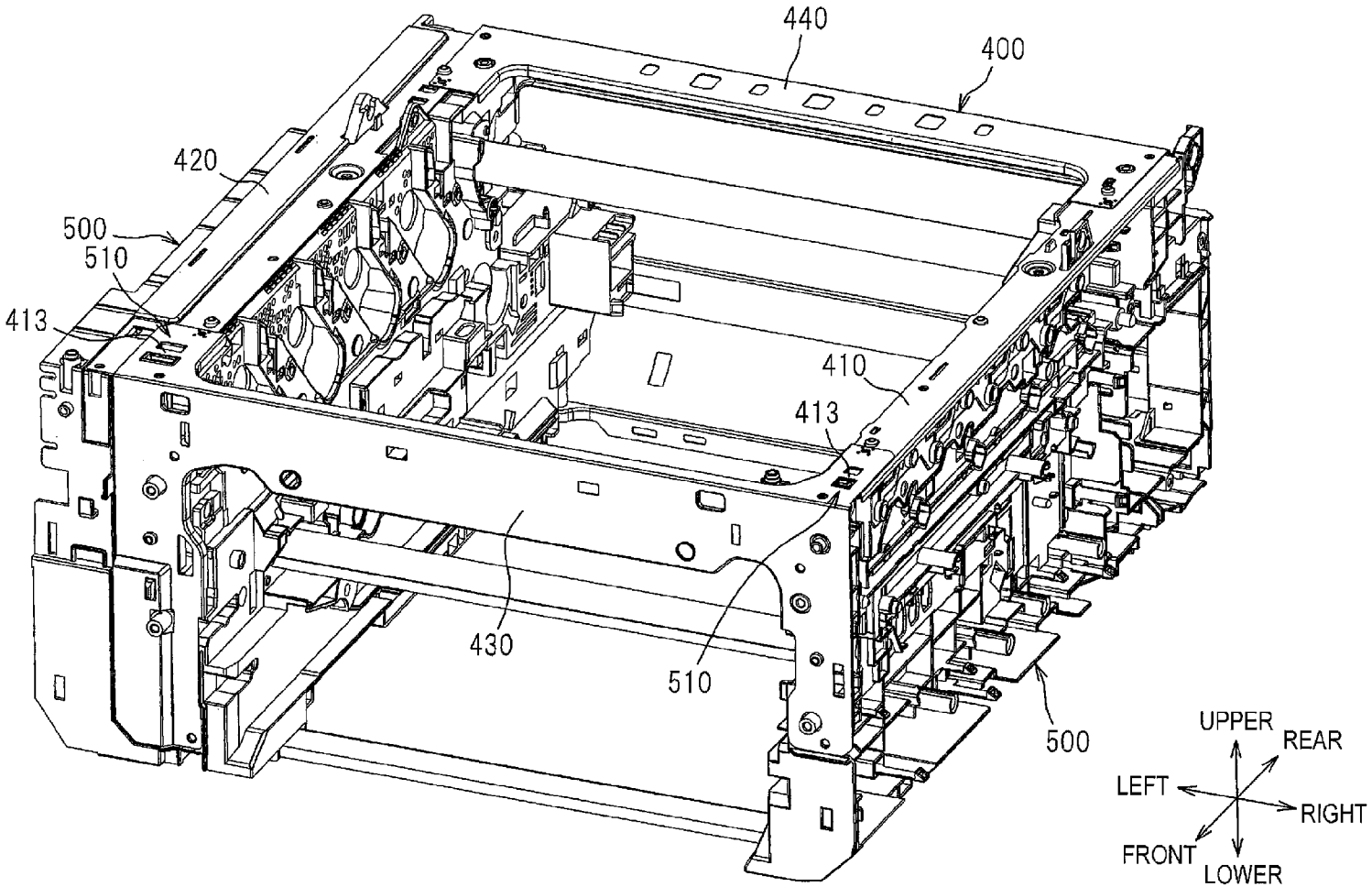
FIG. 7 is a perspective view showing main body frames and the chain body-side metal plate.

As shown in FIGS. 2 and 7, the main body 2 has a pair of left and right main body frames 500 and the main body-side metal plate 400.

The pair of main body frames 500 is made of resins. The right main body frame 500 is arranged below the right support member 200 and the left main body frame 500 is arranged below the left support member 200.

As shown in FIG. 3, the main body frame 500 is configured so that the positioning part 220 of the support member 200 is inserted into a front end portion thereof.

Specifically, the front end portion of the main body frame 500 is formed with a first positioned protrusion 511 that extends upward and a second positioned protrusion 512 that is arranged at a more rearward position than the first positioned protrusion 511 and extends upward. The positioning part 220 is fitted between the first positioned protrusion 511 and the second positioned protrusion 512

Specifically, as shown in FIG. 4, an interval between the first positioned protrusion 511 and the second positioned protrusion 512 is set so that the first positioned protrusion 511 contacts the first positioning protrusion 221 and the second positioned protrusion 512 contact the second positioning protrusion 222 at a state in which the upper cover 3 is closed. Thereby, the first positioned protrusion 511 and the second positioned protrusion 512 are engaged with the positioning part 220, thereby forming the positioned part 510 that determines a position of the support member 200 with respect to the main body frame 500 in the front-rear direction.

The main body-side metal plate 400 is a metal plate having a substantially rectangular frame shape. As shown in FIGS. 2 and 7, the main body-side metal plate 400 has a right frame side 410 that overlaps with an upper surface of the right main body frame 500, a left frame side 420 that overlaps with an upper surface of the left main body frame 500, a front frame side 430 that connects front sides of the right frame side 410 and left frame side 420 and a rear frame side 440 that connects rear sides of the right frame side 410 and left frame side 420. The main body-side metal plate 400 is grounded by a grounding means (not shown).

As shown in FIG. 3, the front sides of the right frame side 410 and left frame side 420 are respectively formed with two holes 411, 412 in parallel in the front-rear direction at positions overlapping with the first positioned protrusion 511 and the second positioned protrusion 512 of the main body frame 500, when seen from the upper-lower direction. The first positioned protrusion 511 of the main body frame 500 is inserted into the front hole 411 and the second positioned protrusion 512 of the main body frame 500 is inserted into the rear hole 412. When the upper cover 3 is closed, the first positioning protrusions 221 of the support members 200 are inserted into the front holes 411 and the second positioning protrusions 222 of the support members 200 are inserted into the rear holes 412.

Also, a surface between the front hole 411 and the rear hole 412 is a contact surface 413 that the second arm 320 of the grounding member 300 contacts.

The main body-side metal plate 400 configured as described above is positioned with respect to the main body frames 500 by a positioning means (not shown). Thereby, the support members 200 that are positioned with respect to the main body frames 500 by the engagement between the positioning parts 220 and the positioned parts 510 are also positioned with respect to the main body-side metal plate 400 via the main body frames 500.

In the below, the operations and effects of the color printer 1 configured as described above are described.

As shown in FIG. 5A, when the cover-side metal plate 100 and the support members 200 are assembled, the first arms 310 are bent and thus brought into contact with the cover-side metal plate 100. At a state in which the upper cover 3 is opened, the second contact portions 323 of the second arms 320 do not contact the main body-side metal plate 400.

Figure 5B:
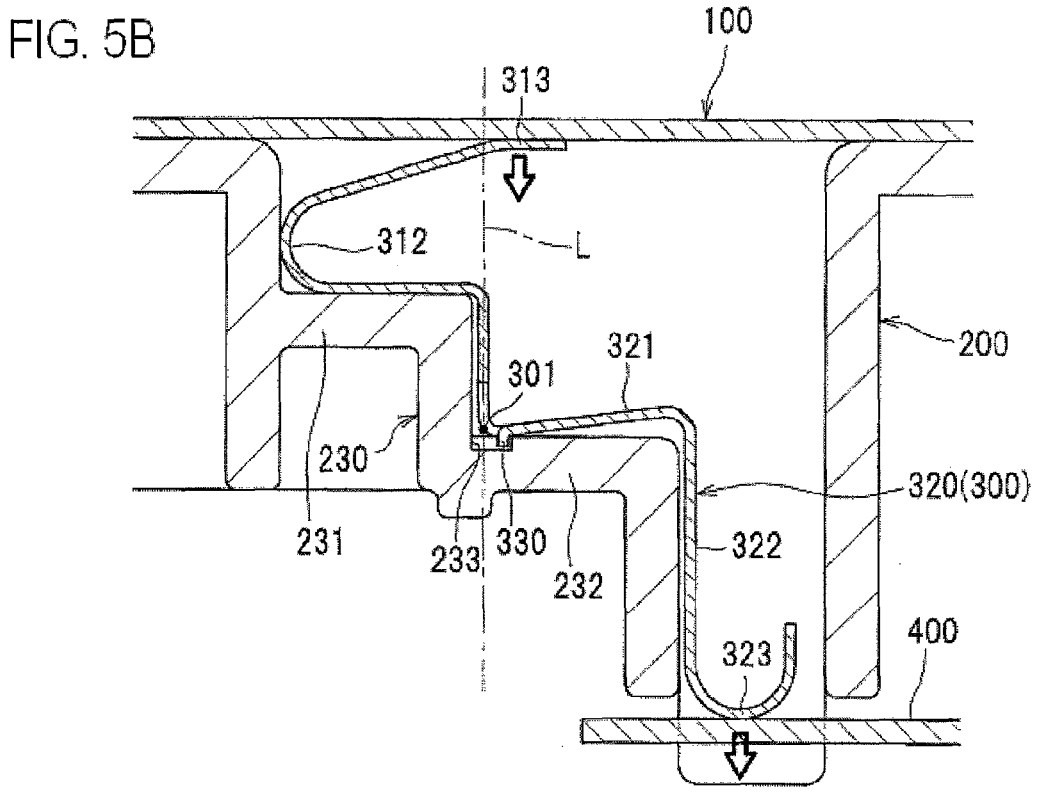

When the upper cover 3 is closed, the second contact portions 323 of the second arms 320 of the grounding members 300 are brought into contact with the upper surface of the main body-side metal plate 400 (for the grounding members 300 provided at the front sides of the support members 200, the contact surfaces 413 of the main body-side metal 400), as shown in FIG. 5B. Thereby, the second contact portions 323 are contacted to the main body-side metal plate 400 and thus pushed up, so that the grounding members 300 are bent.

At this time, since the second extension part 321 is floated from the second support part 232 and only the bent part 301 contacts the second support part 232, the bent part 301 becomes a fulcrum of the grounding member 300. Here, regarding the plane L that passes to the bent part 301 becoming the fulcrum and extends along the opening and closing direction of the upper cover 3, the first contact portion 313 of the first arm 310 and the second contact portion 323 of the second arm 320 are arranged at the same side. Therefore, considering a moment that is applied to the grounding member 300, the second arm 320 is pushed up, so that the first contact portion 313 of the first arm 310 is applied with upward force and the first contact portion 313 is thus strongly pressed to the cover-side metal plate 100. Also, as the first contact portion 313 is strongly pressed to the cover-side metal plate 100, the first arm 310 is applied with downward force. Thereby, the second contact portion 323 of the second arm 320 is also applied with the downward force, so that the second contact portion 323 is strongly pressed to the main body-side metal plate 400. Thereby, it is possible to securely bring the grounding members 300 into contact with the cover-side metal plate 100 and the main body-side metal plate 400.

Like this, the grounding members 300 are contacted to the cover-side metal plate 100 and the main body-side metal plate 400, so that the four positions of the cover-side metal plate 100, which surround the four LED units 40, are electrically grounded. That is, the line connecting the ground points of the cover-side metal plate 100 surround the four LED units 40. Thereby, it is possible to suppress the cover-side metal plate 100 from serving as an antenna, so that it is possible to suppress the cover-side metal plate 100 from emitting the electromagnetic waves, which are generated from the LED units 40, as noises.

The grounding members 300 are supported to the support members 200 that are positioned with respect to the main body-side metal plate 100 via the main body frames 500. Therefore, when closing the upper cover 3, it is possible to securely bring the grounding members 300 into contact with the main body-side metal plate 400.

The grounding members 300 that are provided at the front end portions of the support members 200 are provided in the vicinity of the positioning parts 220 of the support members 200. Accordingly, it is possible to enable the grounding members 300 to contact the main body-side metal plate 400, more securely.

The grounding member 300 consists of the plate spring. Therefore, compared to a configuration in which the grounding member 300 is made of a wire and the like, it is possible to enlarge an area of the contact part between the grounding member and the cover-side metal plate 100 and an area of the contact part between the grounding member and the main body-side metal plate 400, so that it is possible to ground the cover-side metal plate 100, more securely.

The cover-side metal plate 100 is arranged between the control substrate P of the LED units 40 and the four LED units 40. Therefore, it is possible to prevent the noises generated from the control substrate P from influencing the LED units 40. Also, it is possible to prevent the noises generated from the four LED units 40 from influencing the control substrate P.

Although the exemplary embodiment has been described, the invention is not limited to the exemplary embodiment. The specific configuration can be appropriately changed without departing from the gist of the invention.

In the above exemplary embodiment, at the state in which the upper cover 3 is closed, the four positions of the cover-side metal plate 100 surrounding the four LEDs are grounded by the grounding members 300. However, the invention is not limited thereto. For example, the five or more grounding members 300 may be provided and the cover-side metal plate 100 may be grounded at five or more positions so that the five or more grounding members surround the four LED units 40. Preferably, at least one four grounding members 300 is located at each of four corner areas of the cover-side metal plate. Here, the four corner areas mean four areas obtained by dividing the area of the cover-side metal plate in a cross shape.

In the above exemplary embodiment, the positioned part 510 that is engaged with the positioning part 220 of the support member 200 is provided to the main body frame. However, the invention is not limited thereto. For example, the positioned part that is engaged with the positioning part of the support member 200 may be provided to the main body-side metal plate 400. Like this, when the positioned part is provided to the main body-side metal plate 400, it is possible to position the support member 200 with respect to the main body-side metal plate 400 in higher precision.

According to the image forming apparatus configured as described above, the cover-side metal plate is grounded at the four or more positions thereof surrounding the plurality of exposure members. Hence, it is possible to suppress the cover-side metal plate from serving as an antenna, so that it is possible to suppress the cover-side metal plate from emitting the electromagnetic waves, which are generated from the exposure members, as noises.

According to the image forming apparatus configured as described above, the support member that supports the exposure members is a member that is positioned with respect to the main body-side metal plate. Accordingly, it is possible to securely connect the grounding member and the main body-side metal plate by providing the grounding member to the support number.

According to the image forming apparatus configured as described above, it is possible to connect the grounding member and the main body-side metal plate, more securely.

According to the image forming apparatus configured as described above, since the grounded cover-side metal plate is arranged between the control substrate and the exposure members, it is possible to prevent the noises generated from the control substrate from influencing the exposure members.

According to the image forming apparatus configured as described above, it is possible to press the second arm to the main body-side metal plate by the force that is applied to the grounding member as the first arm is brought into contact with the cover-side metal plate.

According to the image forming apparatus configured as described above, since it is possible to enlarge an area of the contact part between the grounding member and the cover-side metal plate and an area of the contact part between the grounding member and the main body-side metal plate, it is possible to ground the cover-side metal plate, more securely.

According to the invention, since the cover-side metal plate is grounded at the four positions surrounding the exposure members that are the generation sources of the noises, it is possible to reduce the noises.

In the above exemplary embodiment, the color printer has been exemplified as the image forming apparatus. However, the invention can be also applied to a complex machine or copier.

What is claimed is:

1. An image forming apparatus comprising:

a main body having an opening;

a plurality of photosensitive members disposed in the main body;

a cover configured to open and close the opening;

at least one grounding member; and a plurality of exposure members provided at the cover and configured to expose the plurality of photosensitive members, respectively, wherein the cover includes a cover-side metal plate provided along a surface of the cover, wherein an entirety of each of the plurality of exposure members overlaps with the cover-side metal plate, when seen in a direction normal to the cover-side metal plate, and wherein at least four positions of the cover-side metal plate, which surround the plurality of exposure members, are electrically grounded by the at least one grounding member in a state in which the cover is closed.

2. The image forming apparatus according to claim 1 further comprising a support member provided at the cover and configured to support the plurality of exposure members, wherein the main body includes a main body-side metal plate with respect to which the support member is positioned, and wherein the support member is provided with the at least one grounding member, the at least one grounding member configured to be brought into contact with the cover-side metal plate and the main body-side metal plate in the state in which the cover is closed.

3. The image forming apparatus according to claim 2, wherein:

the main body includes a positioned part, the support member includes a positioning part configured to be engaged with the positioned part to position the support member with respect to the main body-side metal plate, and the at least one grounding member is provided in the vicinity of the positioning part.

4. The image forming apparatus according to claim 2, further comprising a control substrate configured to control the exposure members, wherein the cover-side metal plate is arranged between the plurality of exposure members and the control substrate.

5. The image forming apparatus according to claim 2, wherein:

the at least one grounding member includes a first arm contacting the cover-side metal plate and a second arm contacting the main body-side metal plate, the first and second arms extend from a point which is a fulcrum in a state that the at least one grounding member is provided to the support member, the first and second arms extend from the fulcrum, and a part of the first arm, which contacts the cover-side metal plate, and a part of the second arm, which contacts the main body-side metal plate, are arranged at the same side of a plane that passes through the fulcrum and extends along an opening and closing direction of the cover.

6. The image forming apparatus according to claim 1, wherein the at least one grounding member is a plate spring.

7. The image forming apparatus according to claim 1, wherein the at least four positions are located at four corner areas of the cover-side metal plate, respectively.

* * * * *